US009698544B2

(12) United States Patent
Wu et al.

(10) Patent No.: US 9,698,544 B2
(45) Date of Patent: Jul. 4, 2017

(54) ELECTRICAL CONNECTOR HAVING A SLOPING OUTER SHELL AND A LIGHT EMITTING MEMBER

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/149,199

(22) Filed: May 9, 2016

(65) Prior Publication Data

US 2016/0329664 A1 Nov. 10, 2016

(30) Foreign Application Priority Data

May 9, 2015 (CN) ..... 2015 1 0231809

(51) Int. Cl.

| | |
|---|---|
| ***H01R 13/66*** | (2006.01) |
| ***H01R 13/717*** | (2006.01) |
| ***H01R 13/502*** | (2006.01) |
| ***H01R 13/58*** | (2006.01) |
| *H01R 107/00* | (2006.01) |

(52) U.S. Cl.

CPC ..... *H01R 13/7175* (2013.01); *H01R 13/502* (2013.01); *H01R 13/582* (2013.01); *H01R 13/6658* (2013.01); *H01R 2107/00* (2013.01)

(58) Field of Classification Search

CPC ..... H01R 13/502; H01R 13/58; H01R 13/66; H01R 13/6658; H01R 13/6466; H01R 13/7175; H01R 13/717; H01R 13/582

USPC ..... 439/620.24, 490, 449, 607.01–607.55

See application file for complete search history.

(56) References Cited

U.S. PATENT DOCUMENTS

| | | | | |
|---|---|---|---|---|
| 4,737,122 A * | 4/1988 | Dechelette | H01R 24/60 | 439/418 |
| 6,916,198 B2 * | 7/2005 | Wu | H01R 13/6589 | 439/497 |
| 2013/0210273 A1 * | 8/2013 | Wu | H01R 13/652 | 439/607.34 |
| 2014/0187087 A1 * | 7/2014 | Mason | H01R 13/6592 | 439/607.36 |

(Continued)

*Primary Examiner* — Chandrika Prasad

(74) *Attorney, Agent, or Firm* — Wei Te Chung; Ming Chieh Chang

(57) ABSTRACT

A plug connector assembly (1) adapted to plug into a receptacle in two reversed directions, includes a mating member (10), a cable (30) electrically connected with the mating member, and an outer shell (50) including a main body (51), and a strain relief member (52) disposed at a rear end of the main body and enclosing the cable. The main body includes a front portion (510) enclosing a rear end (102) of the mating member, and a rear portion (511) opposite to the front portion and connected with the strain relief member. A thickness of the front portion is smaller than a thickness of the rear portion measured along a vertical direction. A thickness of the outer shell measured along the vertical direction is gradually increased in a constant slope along a front to rear direction

17 Claims, 8 Drawing Sheets

(56) References Cited

U.S. PATENT DOCUMENTS

| | | | | |
|---|---|---|---|---|
| 2014/0335729 | A1* | 11/2014 | Little | H01R 24/60<br>439/607.53 |
| 2014/0349514 | A1* | 11/2014 | Yang | H01R 13/6581<br>439/487 |
| 2016/0172791 | A1* | 6/2016 | Fan | H01R 13/6585<br>439/607.05 |

* cited by examiner

ELECTRICAL CONNECTOR HAVING A SLOPING OUTER SHELL AND A LIGHT EMITTING MEMBER

BACKGROUND OF THE INVENTION

1. Field of the Invention

The present invention relates to a plug connector assembly, and more particularly to a plug connector assembly having a thinner structure.

2. Description of Related Arts

U.S. Publication No. 2014/0335729, published on Nov. 13, 2014 to Little et al., discloses a plug connector assembly comprising a mating member, a cable connected with the mating member, and an outer shell enclosing a portion of the mating member and a portion of the cable. The outer shell has a constant thickness along a front end of the outer shell to a rear end of the outer shell. If the cable has a larger diameter, the thickness of the outer shell is increased accordingly.

Hence, an improved plug connector assembly is desired to offer advantages over the related art.

SUMMARY OF THE INVENTION

An object of the present invention is to provide a plug connector assembly having a thinner structure.

To achieve the above-mentioned object, a plug connector assembly adapted to plug into a receptacle in two reversed directions, comprises: a mating member; a cable electrically connected with the mating member; and an outer shell comprising a main body and a strain relief member disposed at a rear end of the main body and enclosing the cable, the main body comprising a front portion enclosing a rear end of the mating member, and a rear portion opposite to the front portion and connected with the strain relief member; wherein a thickness of the front portion is smaller than a thickness of the rear portion measured along a vertical direction and a thickness of the outer shell measured along the vertical direction is gradually increased in a constant slope along a front to rear direction.

According to the present invention, the outer shell of the plug connector assembly has a wedge shape. Therefore, if the cable has a larger diameter, the outer shell could have a thicker size in rear end to enclose the cable and have a thinner size in front end to enclose the mating member that make the outer shell a thinner structure.

DETAILED DESCRIPTION OF THE PREFERRED EMBODIMENT

Figure 1:
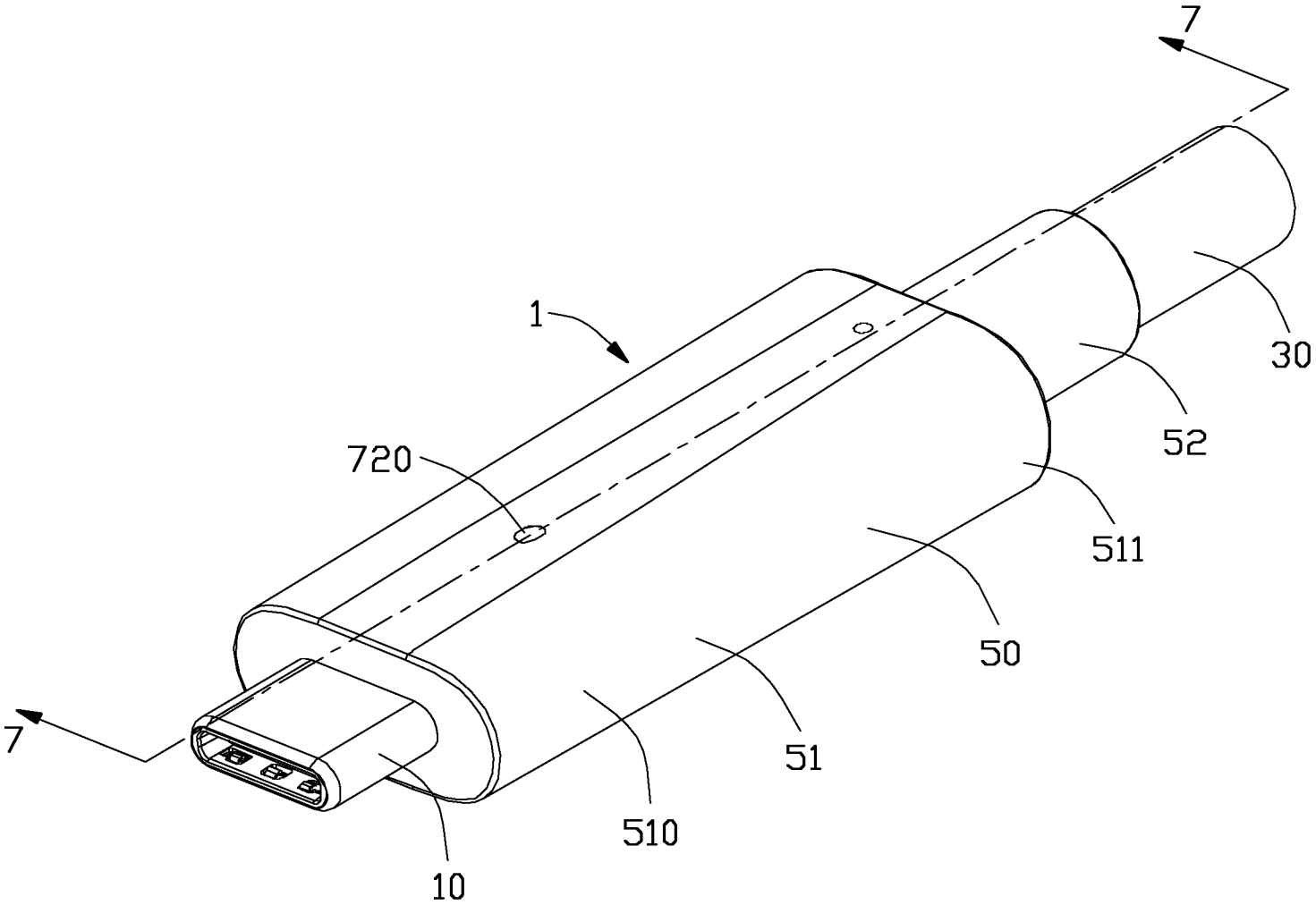
FIG. 1 is a perspective view of a plug connector assembly in accordance with present invention.
Figure 2:
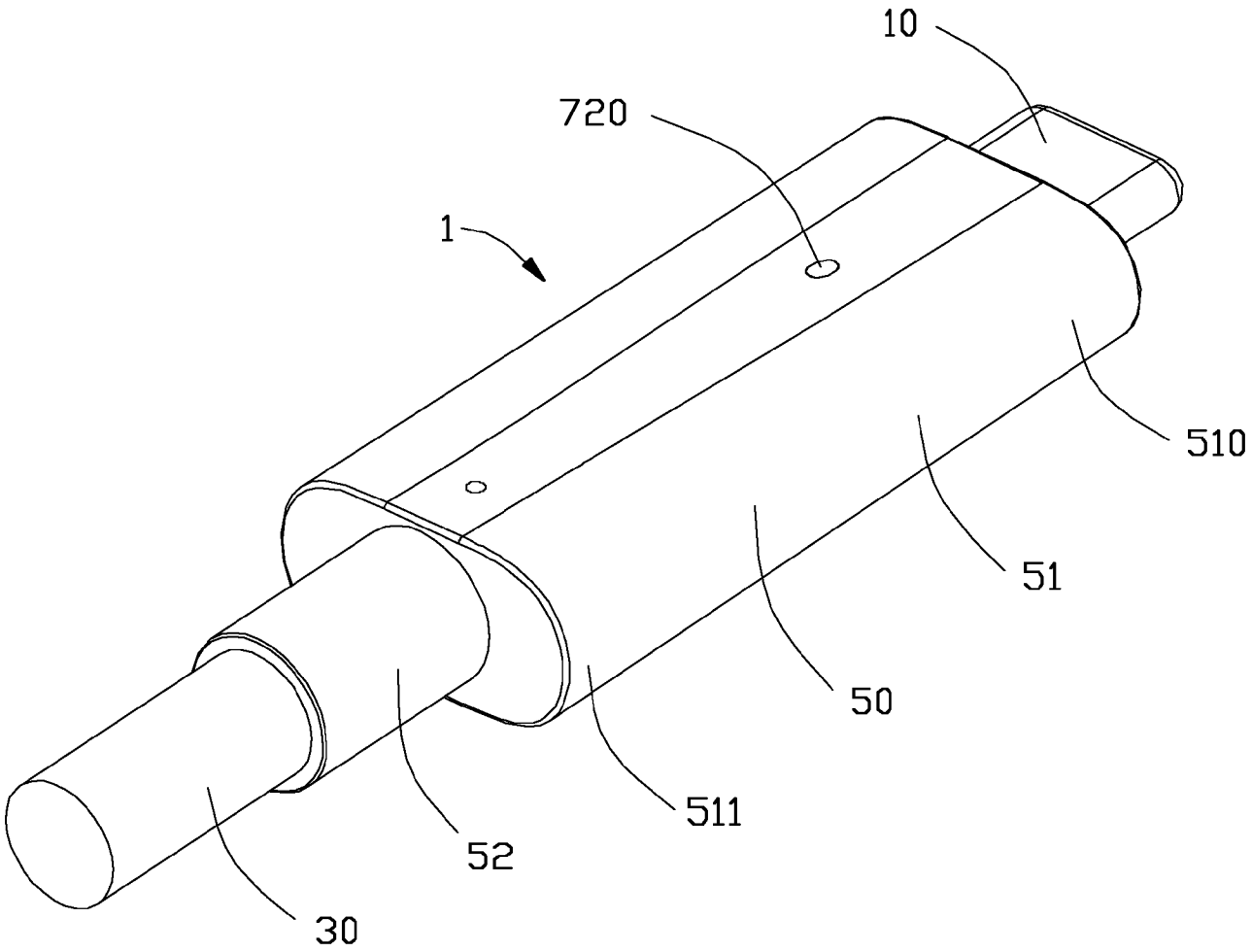
FIG. 2 is another perspective view of the plug connector assembly as shown in FIG. 1.
Figure 3:
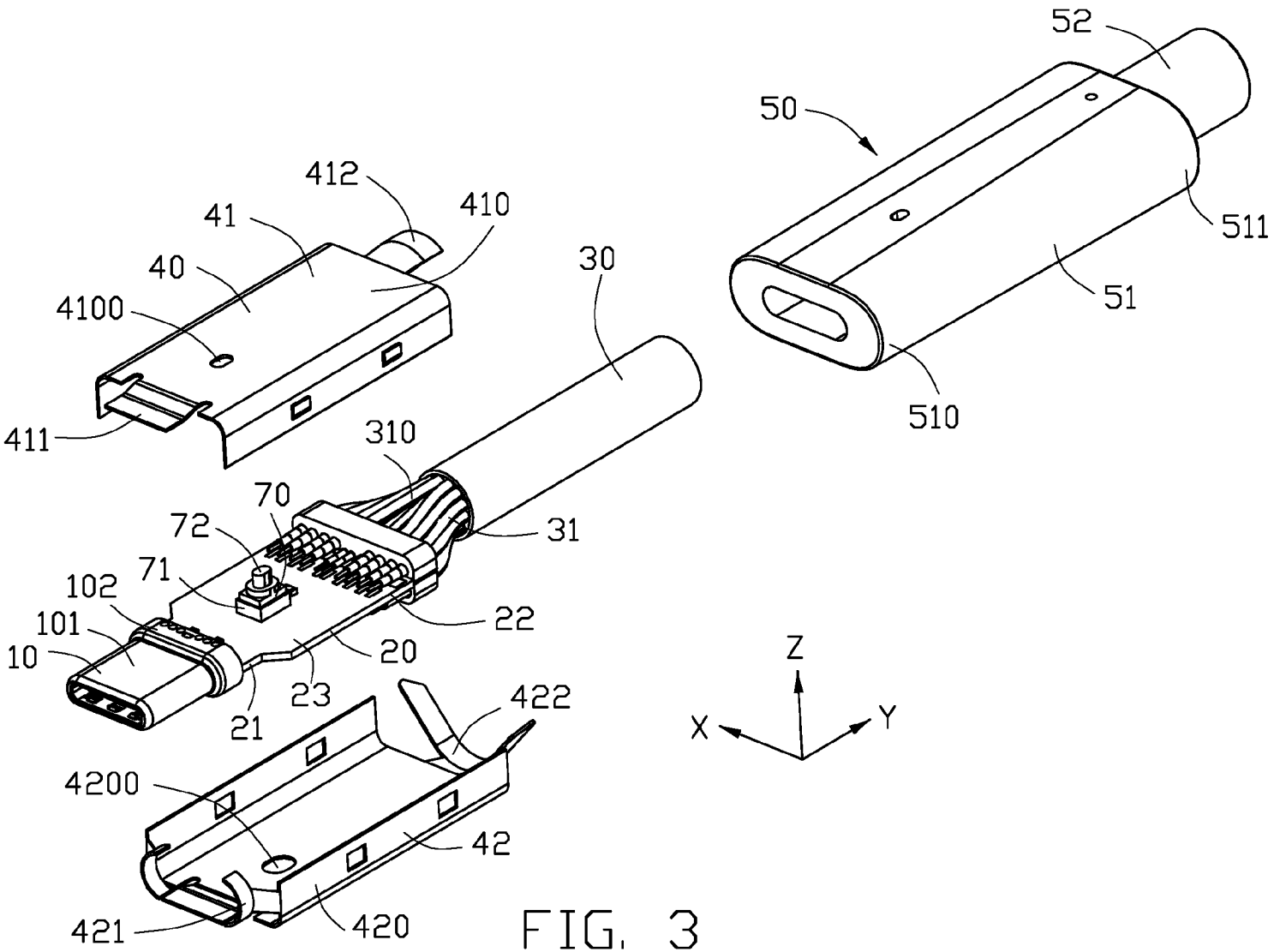
FIG. 3 is a partly exploded view of the plug connector assembly as shown in FIG. 1.
Figure 4:
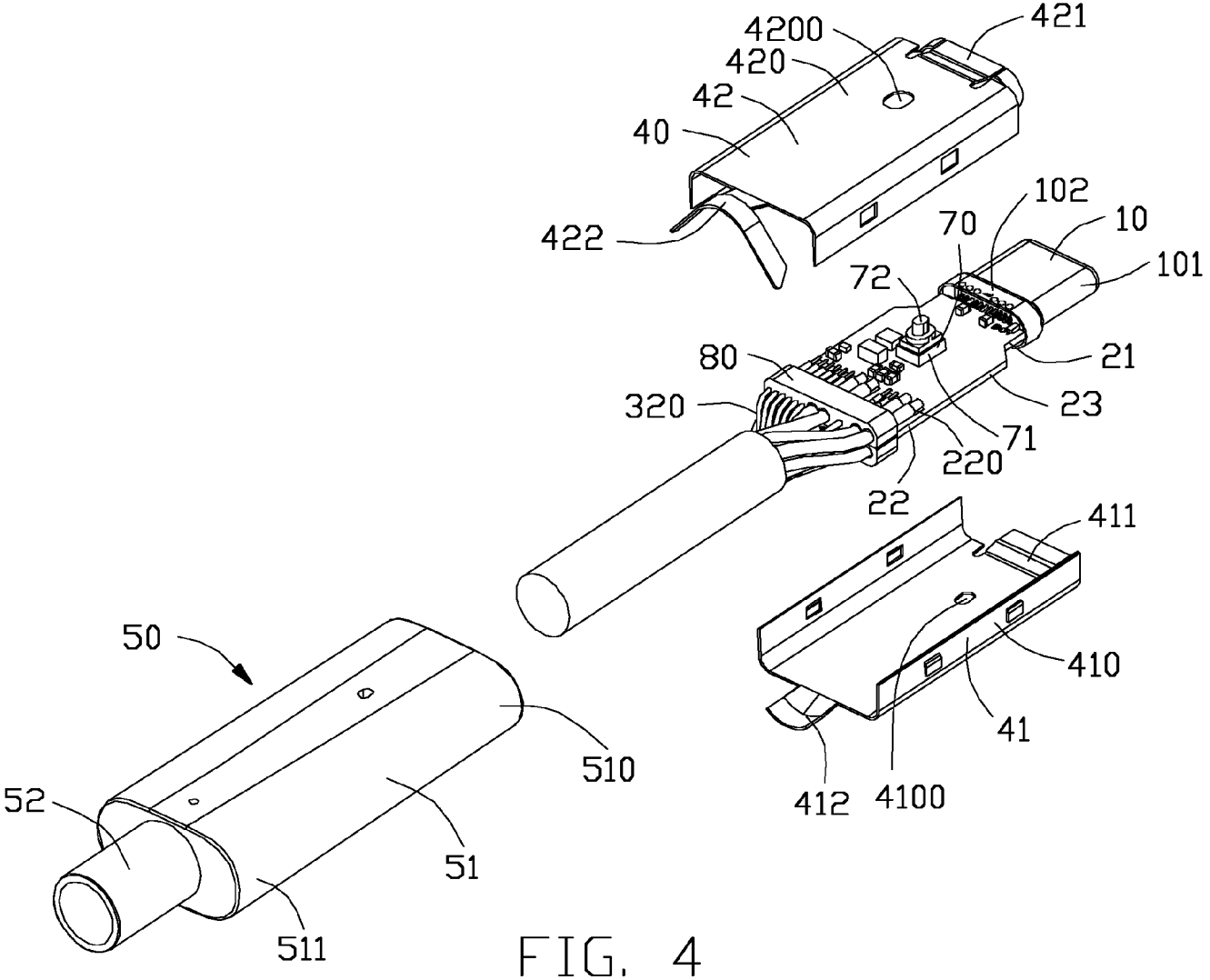
FIG. 4 is another partly exploded view of the plug connector assembly as shown in FIG. 3.
Figure 5:
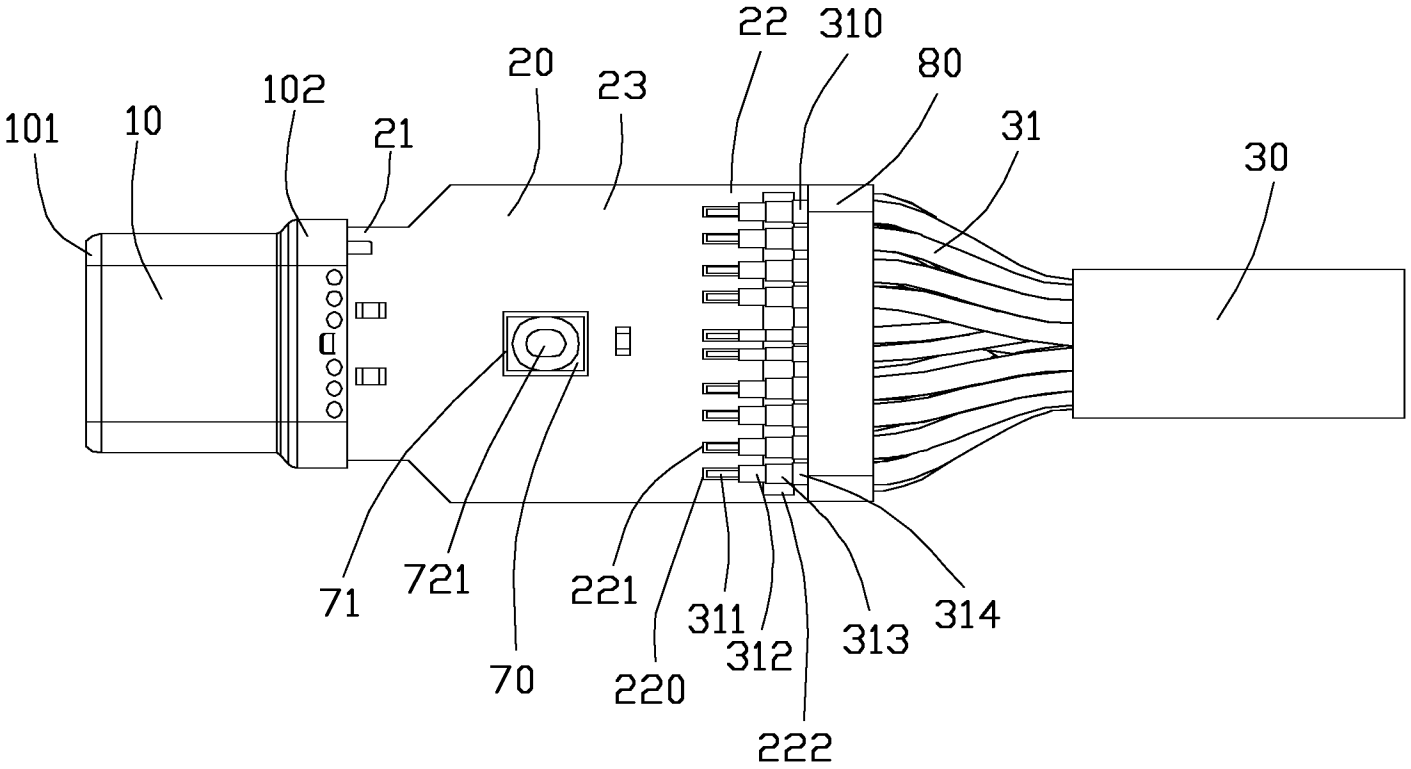
FIG. 5 is a top view of the plug connector assembly as shown in FIG. 1 with the metal shell and the outer shell removed.
Figure 6:
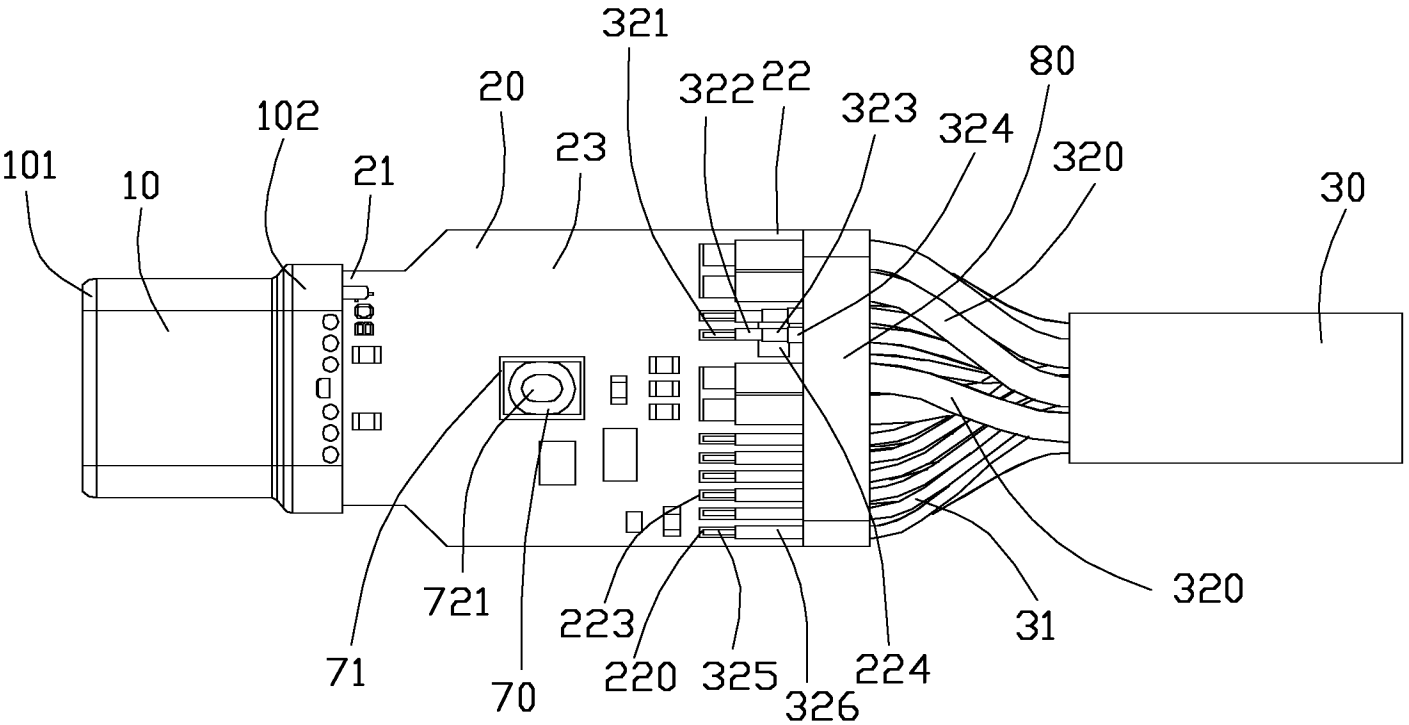
FIG. 6 is bottom view of the plug connector assembly as shown in FIG. 5.
Figure 7:
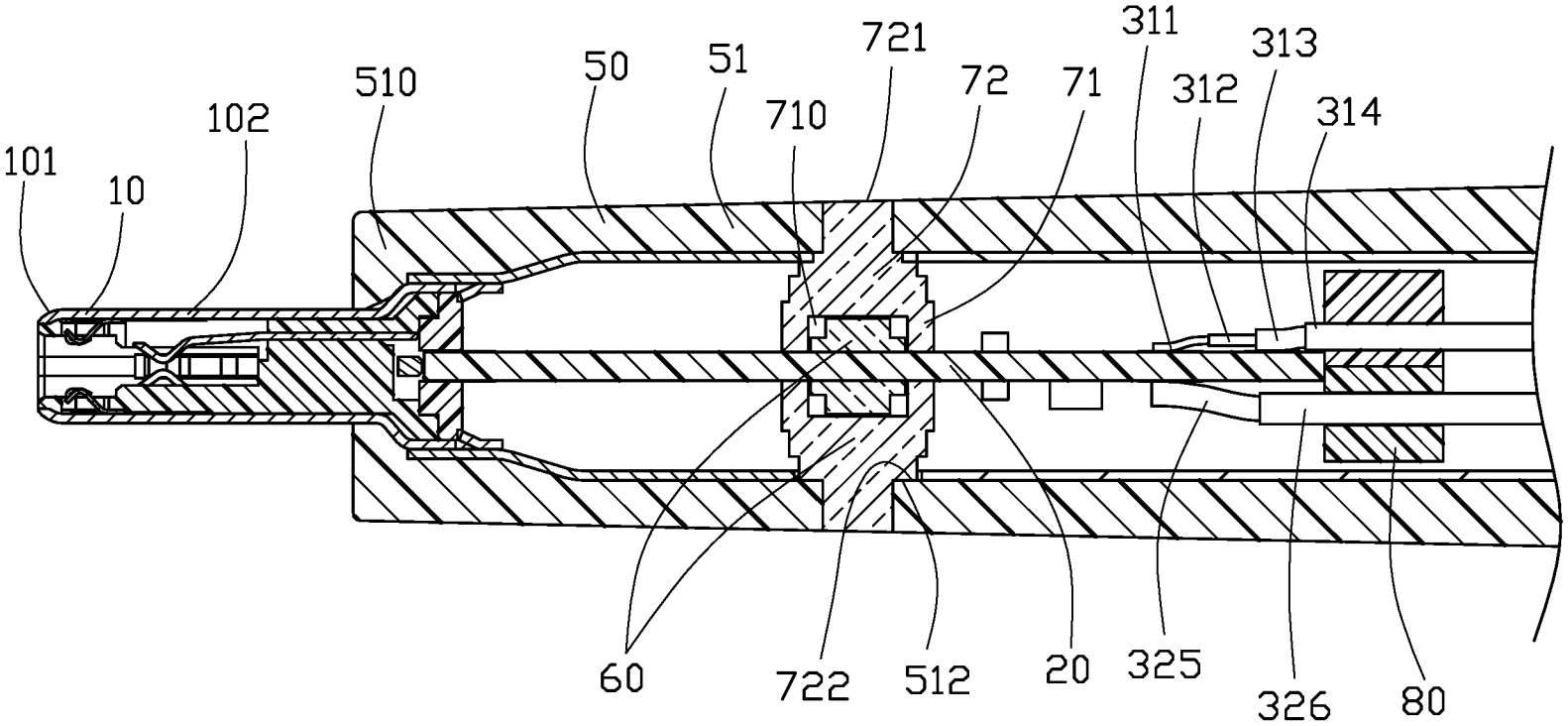
FIG. 7 is a cross-sectional view of the plug connector assembly taken along line 7-7 in FIG. 1.

Reference will now be made in detail to a preferred embodiment of the present invention.

Referring to FIGS. 1 to 7, a plug connector assembly 1 adapted to plug into a receptacle in two reversed directions, comprises a mating member 10, a printed circuit board 20 electrically connected with the mating member 10, a cable 30 electrically connected with the printed circuit board 20, a metal shell 40 connected with the mating member 10, the cable 30 and enclosing the printed circuit board 20, an outer shell 50 disposed at an outer side of the metal shell 40, a pair of light emitting members disposed at two opposite sides of the printed circuit board 20 respectively, and a pair of light guide members or light pipes 70 guiding the lighting from corresponding light emitting members 60 to outer side for user to observe. The cable 30 is electrically connected with the mating member 10 through the printed circuit board 20.

The mating member 10 comprises front mating end 101 for being inserted into the receptacle, and a rear mating end (port) 102 disposed at a rear end of the front mating end 101. The rear mating end 102 is thicker than the front mating end 101.

Referring to FIGS. 3 to 7, the printed circuit board 20 comprises a front end 21 for being connected with the mating member 10, a rear end 22 for being soldered with the cable 30, and a middle portion 23 connected between the front end 21 and the rear end 22. The front end having a width is smaller than a width of the middle portion 23 and a width of the rear end 22. The rear end 22 of the printed circuit board 20 has two opposite sides, both of them soldered with the cable 30. One side of the rear end 22 comprises a plurality of first conductive pads 221 arranged in a row along a transverse direction X, and a second conductive pad 222 disposed at a rear side of the first conductive pads 221. The second conductive pad 222 extends beyond the two end of the row of the first conductive pads 221 along the transverse direction X. Each of the first conductive pads has a same width. The other side of the rear end 22 comprises a plurality of third conductive pads 223 arranged in a row along the transverse direction X, and a fourth conductive pad 224 disposed at a rear side of the second conductive pads 222.

The cable 30 comprises a plurality of wires 31. In this embodiment, the cable has an outer diameter of 5.6 mm. The plug connector assembly further comprises one or more spacers 80 to arrange the wires into first wires 310 for being soldered on the one side of the rear end 22 of the printed circuit board 20, and second wires 320 for being soldered on the other side of the rear end 22 of the printed circuit board 20. All of the first wires 310 are coaxial wires. Each of the first wires 310 comprises a center conductor 311, an inner insulative layer 312 enclosing the center conductor 311, a shielding layer 313 enclosing the inner insulative layer 312, and an outer insulative layer 314 enclosing the shielding layer 313. There are ten first wires 310. Two of first wires 310 have a diameter larger than the other eight first wires 310. The number of the first conductive pads 221 is equal to the number of the first wires 310. The two larger first wires 310 are used to transmit low speed signal, such as USB 2.0 signal. The other eight smaller first wires 310 are used to transmit high speed signal, such as USB 3.0 signal or USB 3.1 signal. Each of the center conductors 311 of the first wires 310 is soldered with corresponding one of the first conductive pads 221. All of the shielding layers 313 of the first wires 310 are soldered with the second conductive pad 222. The eight coaxial wires 310 are divided into four pairs, two pairs of them used for transmitting signal, the other two pairs of them used for receiving signal, The two pairs are arranged in a side of the two first wires 310 used to transmit low speed signal, and the other two pairs are arranged in an opposite side of the two first wires 310 used to transmit low speed signal. There is no need to design a grounding conductive pad disposed between the two pairs of the first conductive pads 221 which are soldered with the two pair of first wires used for transmitting signal or between the other two pairs of the first conductive pads 221 which are soldered with the other two pair of first wires used for receiving signal to reduce cross talk. Therefore, the printed circuit board could designed smaller. All of the central conductors 311 of the first wires 310 are soldered with the first conductive pads 221 at a same time, and all of the shielding layers 313 of the first wires 310 are soldered with the second conductive pad 222 at a same time.

The second wires 320 comprise one pair of coaxial wires and ten single core wires. Each of the coaxial wires comprises a center conductor 321, an inner insulative layer 322 enclosing the center conductor 321, a shielding layer 323 enclosing the inner insulative layer 322, and an outer insulative layer 324 enclosing the shielding layer 323. The pair of coaxial wires is used to transmit high speed signal, such as Display Port signal. Each of the single core wires comprises a conductor 325 and an insulative layer 326 enclosing the conductor 325. Two pairs of the single core wires 320 have larger outer diameters than the others and are used to transmit power signal. All of the conductors 325 of the second wires 320 are soldered on the third conductive pads 223, respectively. Both of the shielding layers 323 of the pair of coaxial wires are soldered on the fourth conductive pad 224. The number of the third conductive pads 223 is less than the number of the second wires 320. Two of the third conductive pads 223 have a width larger than the others. Conductors 325 of one pair of the two pairs of the single core wires having larger outer diameters are soldered on one of the two larger third conductive pads 223, and conductors 325 of the other pair thereof are soldered on the other larger third conductive pads 223, Referring to FIGS. 3, 4 and 7, the metal shell 40 comprises an upper shell 41 and a lower shell 42 latched with the upper shell 41. The upper shell 41 comprises an upper main portion 410, a pair of press portions 411 extending forwardly from the upper main portion 410 and pressing against the rear mating end 102 of the mating member 10, and a mating portion 412 extending rearwardly from the upper main portion 410. The upper main portion 410 defines an upper through hole 4100 for one of the light guide members 70 to extend through. The lower shell 42 comprises a lower main portion 420, a connecting portion 421 extending forwardly from the lower main portion 420 and enclosing the rear mating end 102, and a riveting portion 422 extending rearwardly from the lower main portion 420 for being riveted with the cable 30. The lower main portion 420 defines a lower through hole 4200 for the other light guide member 70 to extend through.

Figure 8:
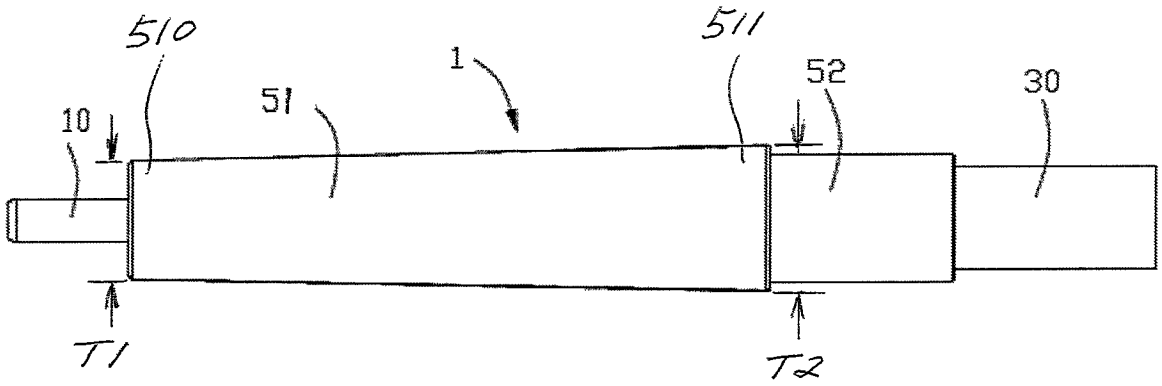
FIG. 8 is a side plan view of the plug connector assembly as shown in FIG.1.

Referring to FIGS. 1 to 8, the outer shell 50 comprises a main body 51, and a strain relief portion 52 extending from a rear end of the main body 51 and enclosing the cable 30. The main body 51 comprises a front portion 510 disposed at an outer side of the mating member 10, and a rear portion 511 disposed at a rear side of the front portion 510 and connected with the strain relief portion 52. The strain relief portion 52 has an outer diameter is equal to 7 mm. The thinnest portion along a vertical direction Z of the front portion 510 of the main body 51, labeled as T1 in FIG. 8, is equal to 6.5 mm. The thickest portion along the vertical direction Z of the rear portion 511 of the main portion 51, labeled as T2 in FIG. 8, is equal to 8 mm. A thickness of the main portion 51 of the outer shell 50 measured along the vertical direction Z is gradually increased in a constant slope along a front-to-back direction Y. The outer shell 50 is over molded with the metal shell 40. Therefore, the outer shell has a thinner structure basis of ensuring the structural strength. Notably, viewed along the front-to-back direction, the front mating port 101 defines the transverse direction X and the vertical direction Y perpendicular to each other and both further perpendicular to the front-to-back direction Y.

The light emitting members 60 could be an LED or other suitable optical light source. Each of the light guide members 70 comprises body portion 71 for being mounted on the printed circuit board 20 and extending portion 72 extending outwardly. The body portion 71 defines a recess for receiving the light emitting member 60. The extending portion 72 has a free end surface 720 exposed to outer side and forming a display face or outer end face 721 for user to observe. The display face 721 has a slope equal to the outer shell 50 so that the display face 721 is generally flush with the outer shell. The two light emitting members 60 are arranged symmetrically along an imaginary horizontal middle plane of the outer shell 50. The two light guide members 70 are arranged symmetrically along the imaginary horizontal middle plane of the outer shell 50. It is noted that the light guiding member 70 further defines an inner abutment face 722 abutting against an inner face 512 of the outer shell 50 and angled with the outer end face 721.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector assembly adapted to plug into a receptacle in two reversed directions, comprising:

a mating member;

a cable electrically connected with the mating member; and an outer shell comprising a main body and a strain relief member disposed at a rear end of the main body and enclosing the cable, the main body comprising a front portion enclosing a rear end of the mating member and a rear portion connected with the strain relief member; wherein a thickness of the front portion is smaller than a thickness of the rear portion measured along a vertical direction; and a thickness of the outer shell measured along the vertical direction is gradually increased in a constant slope along a front to rear direction, wherein at least one light emitting member and at least one associated light guide member are received in the outer shell and the at least one light guide member comprises a display face exposed to an exterior.

2. The plug connector assembly as recited in claim 1, wherein the display face is flush with the outer shell.

3. The plug connector assembly as recited in claim 1, wherein there are two light guide members, one of the light guide members exposed to one side of the outer shell, and the other light guide member exposed to an opposite side of the outer shell.

4. The plug connector assembly as recited in claim 3, wherein the two light guide members are arranged symmetrically along an imaginary horizontal middle plane of the outer shell.

5. The plug connector assembly as recited in claim 1, further comprising a printed circuit board received in the outer shell, the printed circuit board having an end mated with the mating member and an opposite end connected with the cable.

6. The plug connector assembly as recited in claim 5, wherein the cable comprises a plurality of first wires soldered on a side of the printed circuit board, each of the first wires comprising a center conductor, a shielding layer enclosing and insulated from the center conductor, the printed circuit board comprising a plurality of first conductive pads arranged in a row and a second conductive pad disposed at a rear side of the first conductive pads, the center conductors soldered with the first conductive pads, respectively, and the shielding layers soldered with the second conductive pad.

7. The plug connector assembly as recited in claim 6, wherein the first wires comprises a plurality of low speed signal wires for transmitting low speed signal and at least two pairs of high speed signal wires for transmitting high speed signal, and the first conductive pads soldered with the low speed signal wires are disposed between the first conductive pads soldered with the at least two pairs of high speed signal wires.

8. The plug connector assembly as recited in claim 7, wherein:

there are two pairs of first high speed wires and there are two pairs of second high speed wires;

all of the first conductive pads soldered with the two pairs of first high speed wires are disposed at a side of the first conductive pads soldered with the low speed signal wires; and all of the first conductive pads soldered with the two pairs of second high speed wires are disposed at an opposite side of the first conductive pads soldered with the low speed signal wires.

9. The plug connector assembly as recited in claim 8, wherein the two pairs of first high speed wires are immediately adjacent to each other, and the two pairs of second high speed wires are immediately adjacent to each other.

10. The plug connector assembly as recited in claim 6, wherein the cable comprises a plurality of second wires soldered to an opposite side of the printed circuit board, the second wires comprising a plurality of single core wires and a plurality of coaxial wires.

11. A plug connector assembly comprising:

a mating member defining a mating port forwardly communicating with an exterior along a front-to-back direction, viewed along said front-to-back direction, said mating port defining a transverse direction and a vertical direction perpendicular to each other and both to the front-to-back direction;

a printed circuit board located behind the mating member in said front-to-back direction, a front region of the printed circuit board mechanically and electrically connected to the mating member;

a cable located behind the printed circuit board in said front-to-back direction, a rear region of the printed circuit board electrically and mechanically connected to a front end of the cable;

a metal shell enclosing the printed circuit board and corresponding portions of the cable and the mating member; and an insulative outer shell enclosing said metal shell; wherein an contour of said outer shell defines a slope in the front-to-back direction with a dimension of a front end of said outer shell in the vertical direction being smaller than that of the rear end thereof, wherein at least one LED (light emitting diode) is mounted upon the printed circuit board and optically communicating with the exterior via light pipe, and said light pipe forms an outer end face extending in a sloping manner to comply with said slope of the outer shell.

12. The plug connector assembly as claimed in claim 11, wherein the outer shell keeps a constant dimension in the transverse direction between the front end and the rear end.

13. The plug connector assembly as claimed in claim 11, wherein the metal shell keeps a same distance with the printed circuit board in the vertical direction so as to have the outer shell formed with different thickness dimensions in the vertical direction from a front end of the metal shell to a rear end of the metal shell.

14. The plug connector assembly as claimed in claim 13, wherein the thickness dimension of said outer shell is gradually increased from the front end of the metal shell to the rear end of the metal shell.

15. The plug connector assembly as claimed in claim 11, wherein the cable includes two pairs of high power wires and one pair of coaxial differential wires, the printed circuit board forms two pairs of high power pads and a pair of coaxial differential pads between said two pairs of high power pads in an offset manner so as to provide a common grounding pad located behind the pair of coaxial differential pads extending in the transverse direction to be upward in the vertical direction for easy soldering corresponding shielding layer of the corresponding coaxial differential wires.

16. The plug connector assembly as claimed in claim 11, wherein the light pipe further includes an inner abutment face abutting against an inner face of the outer shell and angled with the outer end face.

17. A plug connector assembly comprising:

a mating member defining a mating port forwardly communicating with an exterior along a front-to-back direction, said mating port defining a transverse direction and a vertical direction perpendicular to each other and both to the front-to-back direction;

a printed circuit board located behind the mating member in said front-to-back direction, a front region of the printed circuit board mechanically and electrically connected to the mating member;

a cable located behind the printed circuit board in said front-to-back direction, a rear region of the printed circuit board electrically and mechanically connected to a front end of the cable;

a metal shell enclosing the printed circuit board and corresponding portions of the cable and the mating member; and an insulative outer shell enclosing said metal shell; wherein the cable includes two pairs of high power wires and one pair of coaxial differential wires, the printed circuit board forms two pairs of high power pads and a pair of coaxial differential pads between said two pairs of high power pads in an offset manner so as to provide a common grounding pad located behind the pair of coaxial differential pads extending in the transverse direction to be upward in the vertical direction for easy soldering corresponding shielding layer of the corresponding coaxial differential wires, wherein at least one LED (light emitting diode) is mounted upon the printed circuit board and optically communicating with the exterior via light pipe, and said light pipe forms an outer end face extending in a manner to be flush with said slope of the outer shell, and the light pipe further includes an inner abutment face abutting against an inner face of the outer shell.

* * * * *